US006220440B1

(12) United States Patent
Singerman

(10) Patent No.: US 6,220,440 B1
(45) **Date of Patent: *Apr. 24, 2001**

(54) GIFT PACKAGE KIT

(75) Inventor: Philip Singerman, 339 Brookside, Wilmette, IL (US) 60091

(73) Assignee: Philip Singerman, Wilmette, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/239,262

(22) Filed: Jan. 29, 1999

(51) Int. Cl.[7] ..... B65D 71/00

(52) U.S. Cl. ..... 206/575; 206/232; 229/87.19; 229/923

(58) Field of Search ..... 206/223, 575, 206/497, 525, 232, 579, 581; 229/87.19, 922, 923

(56) References Cited

U.S. PATENT DOCUMENTS

| | | | | |
|---|---|---|---|---|
| 4,867,372 | | 9/1989 | Patterson . | |
| 4,946,039 | * | 8/1990 | Garran | 206/575 |
| 5,060,793 | * | 10/1991 | Hyun et al. | 206/232 |
| 5,232,088 | * | 8/1993 | Leondidis | 206/575 |
| 5,251,759 | | 10/1993 | Gannon et al. . | |
| 5,292,003 | * | 3/1994 | Baghdassarian | 206/575 |
| 5,294,040 | | 3/1994 | Cohen et al. . | |
| 5,441,348 | | 8/1995 | Valentino . | |
| 5,456,062 | | 10/1995 | Wechsler . | |
| 5,490,597 | | 2/1996 | Schluger . | |
| 5,551,570 | | 9/1996 | Shaffer et al. . | |
| 5,579,905 | | 12/1996 | Ingber et al. . | |
| 5,584,429 | | 12/1996 | Savage . | |
| 5,673,796 | | 10/1997 | Tulloch . | |
| 5,691,023 | | 11/1997 | Keller . | |
| 5,740,959 | | 4/1998 | Savage . | |

* cited by examiner

*Primary Examiner*—Luan K. Bui
(74) *Attorney, Agent, or Firm*—Michael G. Kelber

(57) ABSTRACT

The present invention provides a new and useful gift packaging system, method and kit that includes an assortment of gifts and a decorative container and packing materials in which to present the gifts. The gift packaging system is pre-packaged together in a collapsed configuration that can be assembled into a constructed configuration. A container is provided of generally rigid material that is collapsible and constructable. When in the collapsed position, the container forms a generally rectangular, planer configuration. Further, packing material is provided in a partially overlying position with respect to the container. Gifts are also provided in a partially overlying position with respect to the container and the packing material. When in a collapsed configuration, a wrapping substantially encloses the packing material and gifts. The gift packaging kit can be constructed from the collapsed configuration upon removal of the wrapping. When the container is assembled in its constructed configuration, it has a plurality of sides and a bottom. The packing material may be positioned inside the container and the gifts then can be placed on the packing material or may be concealed by the packing material.

11 Claims, 2 Drawing Sheets

GIFT PACKAGE KIT

FIELD OF THE INVENTION

The present invention relates generally to a pre-packaged gift kit.

BACKGROUND OF THE INVENTION

More particularly, the present invention relates to a gift kit that includes a collapsible and constructable container made of rigid material that supports and protects other gift kit contents when collapsed and, in addition to packing materials, also includes gifts within the kit. U.S. Pat. No. 5,251,759, issued to Gannon et al. on Oct. 12, 1993 (Gannon), discloses a gift packaging and wrapping ensemble. The gift ensemble comprises a backing member of generally rigid material providing support and protection for the gift ensemble. It also comprises a collapsible, constructable gift box for packaging gift merchandise, a first wrapping material, a second wrapping material, a gift card, trimming material, and a transparent wrapping material. However Gannon fails to disclose a collapsible, constructable gift box that is generally rigid and rectangular when collapsed. Gannon also fails to disclose a gift kit that includes gifts secured by a material.

U.S. Pat. No. 5,490,597, issued to Schluger on Feb. 13, 1996 (Schluger), discloses another gift packaging and wrapping ensemble. The gift ensemble includes gift-wrapping components in a compartment formed by an external wrap of clear plastic construction material, the gift-wrapping components including a gift box and a mailing box of cardboard construction, whereby the mailing box serves both as a flat support base in the kit and, upon removal of the plastic wrap, as a box for mailing. However, Schluger fails to disclose a collapsible, constructable gift box that is generally rigid when collapsed. Schluzer also fails to disclose a kit that includes gifts.

U.S. Pat. No. 5,551,570, issued to Schaffer et al. on Sep. 3, 1996 (Shaffer), discloses a decorative packaging system including a method and kit therefor. The decorative packaging system includes a basket having a bottom wall, a flexible bag, and a bag closure fastener. The bag has a bottom that is sized and adapted so that the bottom wall of the basket may be positioned against the bottom panel of the bag. However, Shaffer fails to disclose a collapsible, constructable gift box that is generally rigid when collapsed. Shaffer also fails to disclose a kit that includes gifts.

Another problem encountered by those wishing to offer gift packages is that for a retailer to make available to it customers an assortment of gifts to assemble a gift package, a large inventory of gifts and gift packing materials is required. Typically, the types of gifts and packing materials included in gift packages, such as, candy, nuts, juice, cheese, balloons, wrapping materials, etc., come in minimum packages of multiple units, often more than twenty four units or ten pounds per package. The problem of maintaining inventory is compounded when the gifts are foodstuffs, which have a limited shelf life, typically of only about six months.

Accordingly, there remains a need for an improved gift packaging kit that overcomes the shortcomings in the art.

SUMMARY OF INVENTION

The present invention provides solutions to the problems identified above. It is an object of the invention to provide a new and useful gift packaging system, method and kit that includes an assortment of gifts and a decorative container and packing materials in which to present the gifts.

According to one general aspect of the present invention, the gift packaging system is pre-packaged in a collapsed configuration and then can later be constructed into a constructed configuration.

More specifically, a container is provided of generally rigid material that is collapsible and constructable. When in the collapsed position, the container forms a generally rectangular, planer configuration. Packing material is provided in a partially overlying position with respect to the container. Gifts are also provided in a partially overlying position with respect to the container and the packing material. When in a collapsed configuration, a wrapping substantially encloses the packing material gifts.

In a further aspect of the present invention, the container provides a rigid support for the wrapping and protects the packing material and the gifts when the container is in the collapsed configuration.

In a further aspect of the present invention, the gift packaging kit can be constructed from the collapsed configuration upon removal of the wrapping. When the container is configured in its constructed configuration, it has a plurality of sides and a bottom. The packing material may be positioned inside the container and the gifts then can be placed on the packing material or may be concealed by the packing material.

The foregoing features and advantages of the present invention will be apparent from the following more detailed description of the invention. The accompanying drawings, listed hereinbelow, are useful in explaining the invention. Furthermore, other features and advantages of the invention will be apparent from the following detailed description and drawings.

DETAILED DESCRIPTION OF THE INVENTION

Figure 1:
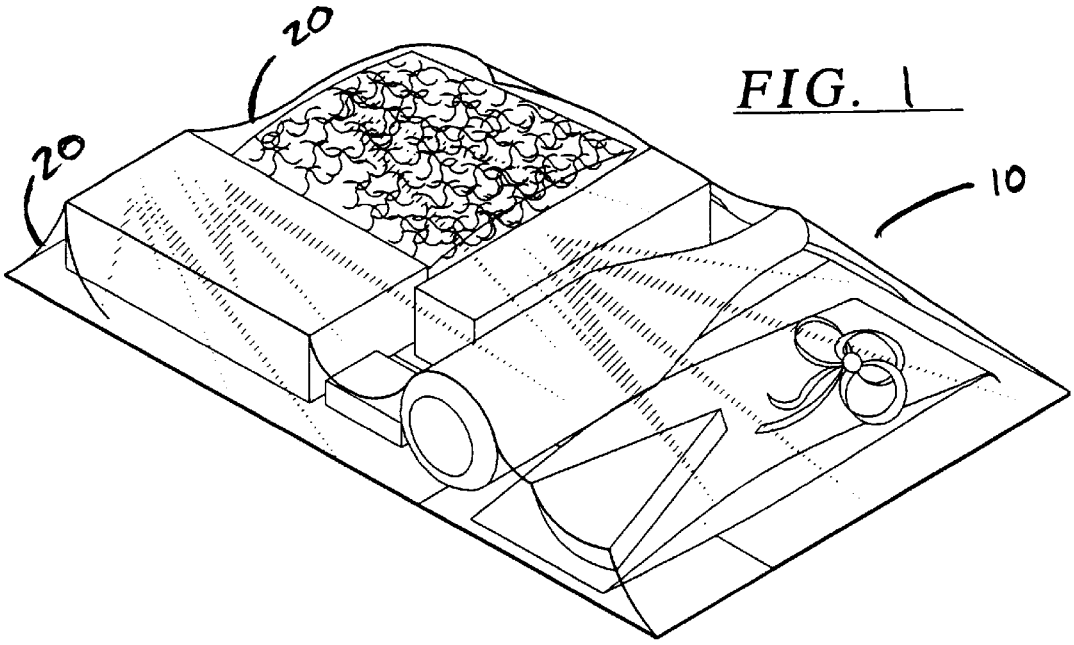
FIG. 1 depicts the gift packaging kit of the present invention in the collapsed position.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

FIG. 1 illustrates a gift packaging kit 10 of the present invention in a pre-packaged or collapsed configuration. In the preferred embodiment, the gift packaging kit 10 would be sold to distributors, retailers, and/or consumers in the collapsed configuration.

Figures 3, 4:
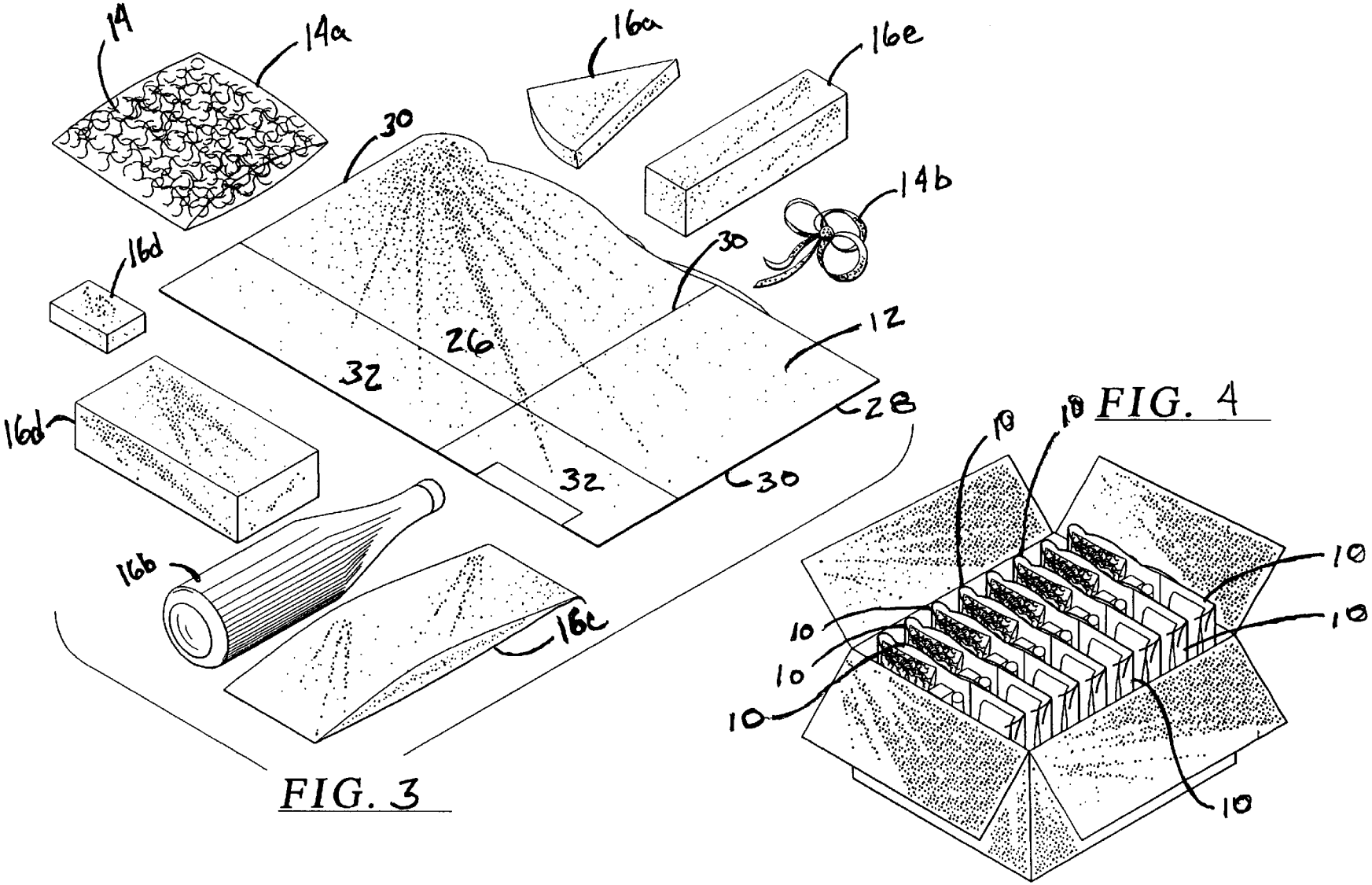
FIG. 3 depicts an exploded view of the gift packaging kit of FIG. 1 in the collapsed position.
FIG. 4 depicts multiple units of the gift packaging kit of FIG. 1 assembled together in a single box.

FIG. 3 illustrates the components of the gift packaging kit 10. In the preferred embodiment, the components include a container 12, packing material 14, and gifts 16. The container is made from a generally rigid material. When in the collapsed position, the container 12 forms a generally rectangular, planer configuration.

As shown in FIG. 1, to secure the gift packaging kit 10 in the collapsed configuration, the packing material 14 and gifts 16 are positioned to at least partially overlap the container 12, and a wrapping 20 substantially encloses the container 12, the packing material 14, and the gifts 16. In the preferred embodiment, the wrapping 20 comprises a shrink-wrap material, as generally known in the art. Other wrapping or means for securing container 12, the packing material 14, and optionally gifts 16, could include net or paper (not shown) or any other suitable material. The generally rigid material of the container 12 in its collapsed configuration provides a sturdy frame around which the wrapping 20 can be enclosed and provides support and protection for the packing material 14 and, if optionally included, gifts 16.

As also shown in FIG. 3, the packing material 14 in the preferred embodiment consists of cellophane (not shown), tissue paper (not shown) and tissue shred 14*a*, but any other packing material 14 would be equally suitable and is contemplated by the invention. As part of the packing material 14, decorative items may be included in the gift packaging kit 10. For example, FIGS. 2 and 3 disclose a ribbon 14*b*. Of course other items could also be included or substituted, such as balloons, placards, banners, greeting cards, or other items, without departing from the present invention.

The gifts 16 in the present invention can include countless items. FIG. 3 illustrates some gifts 16*a–e* included in one embodiment that includes cheese 16*a*, juice 16*b*, a bag of nuts 16*c*, chocolate 16*d*, and a box of crackers 16*e*. Other embodiments (not shown) include gifts 16 that include, golf balls, books, stuffed plush toys, computer disks, miniature footballs, baseballs, and basketballs, jelly beans, cookies, etc. As will be apparent from the present description, there is no limit to the types of gifts 16 that could be included in the gift packaging kit 10 of the present invention.

Figure 2:
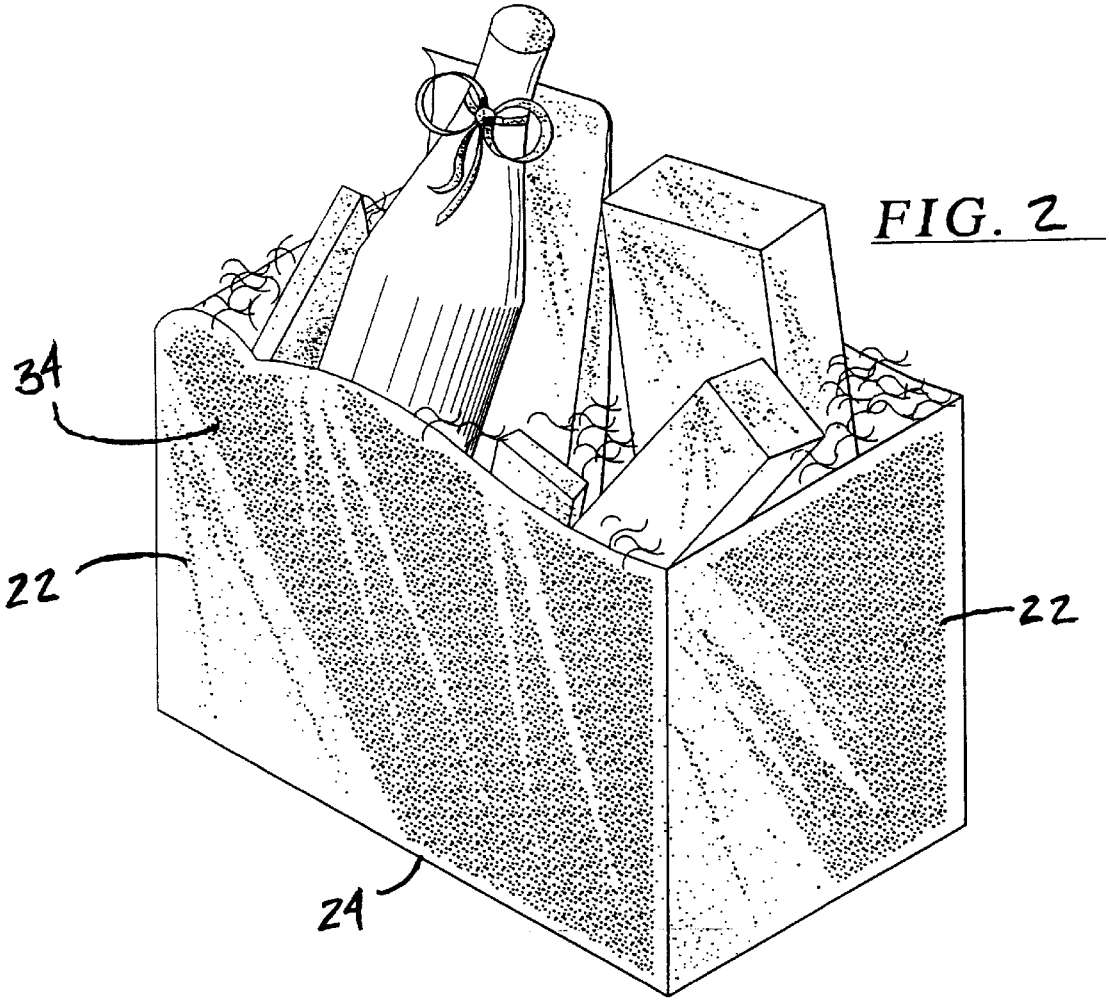
FIG. 2 depicts the gift packaging kit of FIG. 1 in the constructed position.

FIG. 2 illustrates the gift packaging kit 10 in the constructed configuration, as it would be prepared before giving it to a gift recipient (not shown). Upon removal of the wrapping 20, the packing material 14, and the gifts 16 can be removed from their position overlying the container 12 and the container 12 can be constructed, as shown in FIG. 2. In the constructed configuration, the container has a plurality of sides 22 and bottom 24. The container 12 can be constructed in many ways that are well known in the art. For example, in the preferred embodiment, the container 12 is formed from a rectangular piece of cardboard 26 having two opposing edges 28, each having a length. The edges 28 are secured together along a portion of their length to form a loop or tube. This loop or tube is folded in four places 30 (only three folds are visible in FIG. 3) to form four planer sides 22. Flaps 32 depend from each of the four sides 22 of the container 12 and the flaps 32 can be interlocked to form a bottom 24. Any other container 12 or box configuration that is substantially planer and generally rectangular when collapsed and forms a plurality of side walls and a bottom when constructed would work equally well for the invention.

Once the container 12 is constructed in its three dimensional, constructed configuration, the packing material 14 can be placed in the container 12 and the gifts 16 can be distributed within the container 12. The packing material 14 thus provide support for the gifts 16 and also can partially conceal the gifts 16 underneath the packing material 14, making it more exciting for the recipient of the gift packaging kit 10 recipient to uncover the gifts 16.

In the preferred embodiment, the sides 22 of the container 12 are decorated to correspond to a particular occasion, and the packing material 14 and gifts 16 also corresponds with the occasion and decoration on the container 12 to form a particular ensemble. Thus, for example, a gift package kit 10 for Valentine's Day may be designed with red or pink colors and hearts on the container 12 and matching coloring on the packing material 14, whereas another gift package kit 10 for home warming may provide a depiction of a house on the container 12. The variety of themes and combinations of decoration and packing material for ensembles is countless; thus the examples provided are not to limit the present invention.

Another feature of the preferred embodiments is to provide a wrapping 20 that is transparent so that the decorative design 34 and the gifts 16 are visible through the wrapping. Thus, retail or wholesale customers or can select a desirable gift packaging kit 10 from an assortment of kits containing different gifts 16 and different designs.

Thus from the foregoing description, it will be apparent that a distributor, such as, for example, a flower or gift delivery service or a retailer, may purchase a quantity of the gift packaging kits 10 of the present invention. This quantity could be a single gift package kit 10 ensemble or could be an assortment of different ensembles of gift package kits 10. During shipping and storage, the rigid material of the container and the wrapping provides protection for the gifts 10 and the packing material 14 of each of the gift packaging kit 10 ensembles, as shown in FIG. 4.

Another advantage of the invention, as discussed above, is that it provides a distributor or retailer with an assortment of gift packaging kits 10 without needed to keep a large inventory of gifts 16 and packing material 14. Additionally, providing a wrapping 20 that is transparent or that can otherwise be seen through allows customers to select an ensemble having a desired theme and desired gifts 16.

While the invention has been particularly shown and described with reference to a particular embodiment thereof, it will be understood by those skilled in the art that various changes in form and detail may be made therein without departing from the spirit and scope of the invention. The present example and embodiment, therefore, are to be considered in all respects as illustrative and not restrictive, and the invention is not to be limited to the details given herein.

I claim:

1. A gift packaging kit comprising the following components:

a container of rigid material that is collapsible and constructable, the container forming a generally rectangular, planar configuration when collapsed and forming a three dimensional configuration having a plurality of sides and a bottom when constructed;

a piece of packing material being in a partially overlying position with respect to the container when the container is collapsed;

a wrapping substantially enclosing the packing material and the container; and a gift in a partially overlying position with respect to the container and enclosed by the wrapping, wherein the gift is selected from the group consisting of:

cheese, juice, nuts, chocolate, crackers, balls, golf balls, miniature footballs, baseballs, basketballs, books, plush toys, computer disks, and cookies.

2. The kit of claim 1, further comprising a plurality of gifts, each in a partially overlying position with respect to the container and enclosed by the wrapping.

3. The kit of claim 1, wherein the container has a decoratively designed exterior surface.

4. The kit of claim 1, wherein the wrapping comprises a transparent material.

5. The kit of claim 1, wherein the wrapping comprises a net material.

6. The kit of claim 1, wherein the wrapping comprises a net material.

7. A gift packaging kit comprising the following components:

a container of rigid material that is collapsible and constructable forming a generally rectangular, planar configuration when collapsed and forming a three dimensional configuration having a plurality of sides and a bottom when constructed;

a gift being in a partially overlying position with respect to the container when the container is collapsed, wherein the gift is selected from the group consisting of:

cheese, juice, nuts, chocolate, crackers, balls, golf balls, miniature footballs, baseballs, basketballs, books, plush toys, computer disks, and cookies;

a piece of packing material for supporting the gift, the packing material being in a partially overlying position with respect to the container when the container is collapsed; and a wrapping substantially enclosing the gift, the packing material, and the container when the container is collapsed;

whereby the container provides a rigid support for the wrapping and protects the gift and the packing material when the container is in the collapsed configuration.

8. The kit of claim 7, further comprising a plurality of gifts, all positioned partially overlying the container and being enclosed by the wrapping.

9. The kit of claim 8, wherein the wrapping comprises a transparent material.

10. The kit of claim 9, wherein the plurality of gifts and the packing material is visible through the wrapping.

11. The kit of claim 7, wherein the wrapping comprises a net material.

* * * * *